US005695286A

United States Patent [19]

Williamson et al.

[11] Patent Number: 5,695,286

[45] Date of Patent: Dec. 9, 1997

[54] BOTTOM LIFT BULK BAG

[75] Inventors: Robert R. Williamson; Norwin C. Derby, both of Dallas, Tex.

[73] Assignee: Super Sack Mfg. Corp., Dallas, Tex.

[21] Appl. No.: 633,286

[22] Filed: Apr. 16, 1996

[51] Int. Cl.[6] ..... B65D 33/14

[52] U.S. Cl. ..... 383/24; 383/16

[58] Field of Search ..... 383/16, 24, 107, 383/21, 22, 121

[56] References Cited

U.S. PATENT DOCUMENTS

| | | | |
|---|---|---|---|
| 3,674,073 | 7/1972 | Hendon | 383/24 X |
| 3,962,959 | 6/1976 | Williamson . | |
| 4,113,146 | 9/1978 | Williamson . | |
| 4,143,796 | 3/1979 | Williamson et al. . | |
| 4,194,652 | 3/1980 | Williamson | 383/24 |
| 4,224,907 | 9/1980 | Williamson . | |
| 4,457,456 | 7/1984 | Derby et al. . | |
| 4,479,243 | 10/1984 | Derby et al. . | |
| 4,759,473 | 7/1988 | Derby et al. . | |
| 5,076,710 | 12/1991 | Derby . | |
| 5,158,367 | 10/1992 | Derby . | |
| 5,165,802 | 11/1992 | Derby . | |
| 5,203,633 | 4/1993 | Derby . | |

FOREIGN PATENT DOCUMENTS

| | | | |
|---|---|---|---|
| 2306134 | 10/1976 | France | 383/16 |
| 2824929 | 12/1979 | Germany | 383/24 |
| 1501763 | 2/1978 | United Kingdom . | |
| 1536701 | 12/1978 | United Kingdom . | |
| 1536702 | 12/1978 | United Kingdom . | |
| 2161452 | 1/1986 | United Kingdom | 383/24 |

*Primary Examiner*—Jes F. Pascua

*Attorney, Agent, or Firm*—Michael A. O'Neil; Russell N. Rippamonti

[57] ABSTRACT

A bottom lift bulk bag (10) comprises one or more sidewalls (12) defining the interior (14) of the bulk bag. The lower end of the bulk bag is closed by a bottom wall (22) which is secured to the lower ends of the sidewall panels. The material of the bottom wall is extended in the form of a pair of opposed lift loops (26) which are secured in place by seams (28) interconnecting the lower ends of the sidewalls and the bottom wall. In the use of the bulk bag, rigid lifting members (66) are extended through the lift loops and are used to lift the bulk bag from the bottom.

7 Claims, 5 Drawing Sheets

68'
149
146
74
142
145
72
72'
70'
74'

74
60
68
68
72
72
72
70
66
62
70
66
64
70
66
70
66
70
80
84
88
88
86
82
82

BOTTOM LIFT BULK BAG

BACKGROUND OF THE INVENTION

At the present time, flexible intermediate bulk containers, also known as bulk bags, are utilized to receive, store, transport and discharge flowable solids of all types, including but not limited to, minerals, chemicals, foodstuffs, etc. In certain instances, bulk bags are adapted for use with fluidized materials, semi-liquids and liquids. Although various types of bulk bags are known, modern bulk bags are most often constructed of a plurality of panels each comprising woven polypropylene fabric.

In the past, most bulk bags have been adapted for top lifting. That is, prior bulk bags have usually been provided with lift loops, lift straps or lift sleeves. By means of such construction, bulk bags are adapted for engagement by forklift trucks, cranes and similar lifting apparatuses which manipulate the bulk bags from the top.

The construction of bulk bags for top lifting comprises one of the most expensive aspects of bulk bag manufacturing. First, the material comprising the lift loop, lift strap or lift sleeve must be provided. Of even more importance is the fact that the strength of the fabric and the construction of the seams used to join the fabric panels comprising the bulk bag must be specially designed to transfer the load contained within the bulk bag upwardly from the bottom of the bulk bag to the lift loops, lift straps or lift sleeves located at the top of the bulk bag. In accordance with the present invention, it has been determined that if the bag can be lifted from the bottom, less expensive fabric and less expensive manufacturing techniques can be used in construction of the bulk bag, thereby providing a lower cost bulk bag which nevertheless has the same capacity as more expensive bulk bags heretofore used.

SUMMARY OF THE INVENTION

In accordance with the preferred embodiment of the invention, a bulk bag comprises a plurality of sidewall panels, it being understood that the bulk bag can also be constructed using a single, circularly woven sidewall panel. A top wall is provided at the upper end of the sidewalls and is secured thereto by sewing and/or adhesive construction. The top wall may be provided with a fill spout, also known in the industry as an inlet spout, top hat spout or intake chute. Alternatively, the top wall of the bulk bag may comprise a duffel top, also known as a skirt top. In other applications of the invention, the top wall may be dispensed with entirely, which construction is referred to in the industry as a no-top or open top bulk bag.

A bottom wall is provided at the lower ends of the sidewalls and is secured thereto by means of sewing and/or adhesive assembly techniques. The bottom wall may be provided with a discharge spout, also known in the industry as a discharge chute, bottom spout or bottom outlet. The bottom wall may also comprise a full open bottom, also known as a full discharge bottom. In certain applications of the invention, the bottom wall of the bulk bag may comprise a plain bottom, also known as a solid bottom.

In accordance with the preferred embodiment of the invention, the fabric of the bottom wall of the bulk bag extends beyond the sidewalls in the form of a pair of opposed loops, each extending the entire length of one of the sidewalls of the bulk bag. The loops may be initially tacked, sewn or secured in place to facilitate construction of the bulk bag. However, the interconnection of the sidewalls to the bottom wall of the bulk bag serves as the primary connection between the distal ends of the fabric of the bottom wall and an intermediate point on the bottom wall, thereby forming the bottom wall loops of the present invention and securing them in place.

Bulk bags constructed in accordance with the present invention are lifted from the bottom. Lifting members comprising tubes or rods are extended through the lift loops at the bottom of the bulk bags. A suitable lifting mechanism, such as a crane or the like, is secured to the lifting members by means of chains, wire ropes, etc. The chains or wire ropes may be interconnected by suitable spacers to prevent shifting of the load within the bulk bag, if desired. In accordance with another aspect of the invention, a forklift truck is provided with adapters spaced apart sufficiently to be received within the lift loops at the bottom of the bulk bag, thereby facilitating the lifting of the bulk bag from the bottom thereof.

BRIEF DESCRIPTION OF THE DRAWINGS

A more complete understanding of the present invention may be had by reference to the following Detailed Description when taken in conjunction with the accompanying Drawings, wherein.

DETAILED DESCRIPTION OF THE INVENTION

Figure 1:
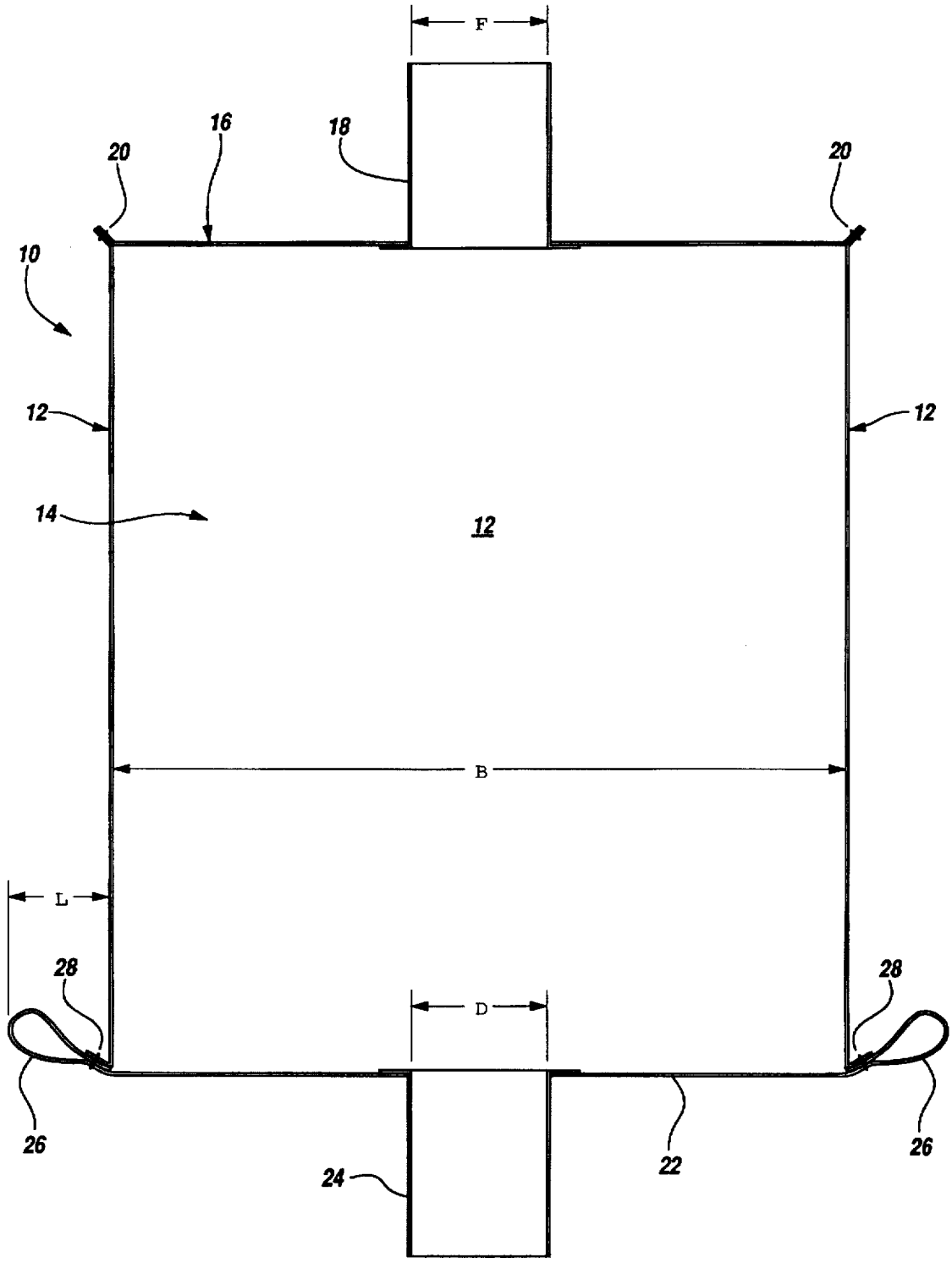
FIG. 1 is a sectional view of a bulk bag incorporating the invention.

Referring now to the Drawings and particularly to FIG. 1 therein, there is shown a bulk bag 10 incorporating the invention. The bulk bag 10 is preferably constructed from a plurality of panels each comprising woven polypropylene. It will be understood, however, that other materials can be used in the practice of the invention, if desired.

The bulk bag 10 includes one or more sidewall panels 12. If multiple sidewall panels 12 are employed in the construction of the bulk bag 10, the sidewall panels may be joined together using conventional sewing techniques, such as those well-known in the bulk bag manufacturing industry. Alternatively, the sidewall panels 12 may be interconnected utilizing adhesive manufacturing techniques. The sidewall panel or panels 12 define the material receiving interior or body 14 of the bulk bag 10.

The bulk bag 10 may be provided with a top wall 16, if desired. The top wall 16 may in turn be provided with a fill spout 18, also known in the industry as an inlet spout, a top hat spout or an intake chute. The cross-sectional dimension F of the inlet spout 18 relative to the cross-sectional dimension B of the interior 14 of the bulk bag 10 may be varied in accordance with the requirements of particular applications of the invention. A fill spout 18 having an interior dimension F closely matched to the interior dimension B of the interior 14 of the bulk bag 10 is frequently referred to as a double top or a skirt top. As will be recognized by those skilled in the art, in certain applications of the invention the top wall 16 can be dispensed with entirely, in which case the bulk bag 10 is referred to as a no-top or an open top bulk bag.

If the top wall 16 is employed, it is secured to the sidewall or sidewalls 12 of the interior 14 of the bulk bag 10 by means of conventional sewing techniques thereby defining a seam 20 between the top wall 16 and the sidewall or sidewalls 12. Alternatively, the top wall 16 may be secured to the sidewall or sidewalls 12 by means of conventional adhesive construction techniques. Typically, the latter manufacturing process also results in a seam 20 between the top wall 16 and the sidewall or sidewalls 12.

A bottom wall 22 is secured to the lower ends of the sidewall panel or panels 12. The bottom wall 22 may be provided with a discharge spout 24, also known in the industry as a discharge chute, bottom spout or bottom outlet. The interior dimension D of the discharge spout 24 relative to the interior dimension B of the interior 14 of the bulk bag 10 may be varied in accordance with the requirements of particular applications of the invention. If the interior dimension D of the discharge spout 24 is closely matched to the interior dimension B of the interior 14 of the bulk bag 10, the discharge spout is sometimes referred to as a full open bottom or a full discharge bottom. In certain applications of the invention, the discharge spout 24 is dispensed with entirely, in which event the bulk bag 10 may be referred to as a plain bottom or solid bottom bulk bag (see FIG. 4). In the latter event, the bulk bag is discharged either by cutting or slitting the bottom wall 22, or by tipping the bulk bag upside down so that it is discharged from the top.

Additionally, the bag of the present invention may include internal baffles of types well known in the art of bulk bag construction. Typical examples of such baffles are disclosed in U.S. Pat. Nos. 5,076,710; 5,165,802; 5,203,633; and currently pending U.S. application Ser. Nos. 08/375,396 and 08/417,898, the disclosure of each incorporated herein by reference.

In accordance with the present invention, the bottom wall 22 of the bulk bag 10 is extended beyond the sidewalls 12 to provide a pair of lift loops 26. The lift loops 26 are characterized by dimension L selected in accordance with the requirements of particular applications of the invention. In most instances, the bottom wall 22 of the bulk bag 10 will have a square or rectangular configuration. In such instances, the length of the lift loops 26 is equal to the dimension of the adjacent sidewall panel 12 comprising the interior 14 of the bulk bag 10. For example, the bottom wall 22 may comprise a square configuration having dimensions of approximately 36 inches by 36 inches, and the lift loops 26 may be defined by a dimension L of about 4 inches.

In the construction of the bulk bag 10, the lift loops 26 of the bottom wall 22 may be initially tacked, sewn or adhesively secured in place. Preferably, however, the primary attachment of the distal edges of the bottom wall 22 to selected points at the interior thereof to form the lift loops 26 comprises seams 28 which are constructed by conventional sewing techniques. The seams 28 serve to connect the lower ends of the sidewall panel or panels 12 to the bottom wall 22 and also serve to secure the distal edges of the bottom wall 22 to the lower ends of the sidewall panel or panels 12 thereby securing the loops 26 in place.

Figure 1A:
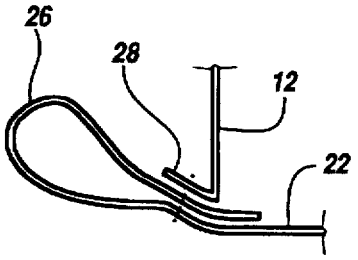
FIG. 1A is an enlarged sectional view illustrating a lift loop and bottom seam of the bulk bag of FIG. 1.

FIG. 1A illustrates the lift loop 26 and the bottom seam 28 of the bulk bag of FIG. 1. The bottom wall 22 of the bulk bag 10 is extended beyond the sidewall 12 to form the lift loop 26. The lift loop 26 is formed by folding back a first opposing edge of the bottom wall 22 toward the sidewall panel 12, inserting the first edge between the bottom wall 22 and sidewall panel 12 and concurrently securing the extended first edge of the bottom wall 22, the sidewall 12 and the bottom wall 22 with seam 28.

Figure 1B:
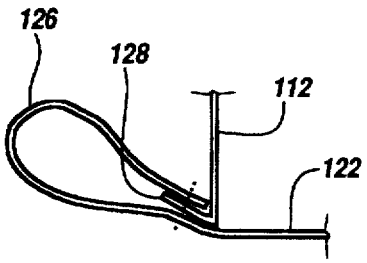
FIG. 1B is an enlarged sectional view illustrating a first alternative embodiment of the lift loop and bottom seam of the bulk bag of FIG. 1.

FIG. 1B discloses a first alternative embodiment of the bottom seam 28 incorporating many important parts which are substantially identical in construction and function to component parts of the lift loop 26 and bottom seam 28 illustrated in FIG. 1A. The bottom wall 122 of the bulk bag 10 is extended beyond the sidewall 112 to form the lift loops 126. The lift loop 126 is formed by folding back a first opposing edge of the bottom wall 122 toward the sidewall panel 122, positioning a lower portion of the sidewall panel 122 between the extended edge of the bottom wall and the bottom wall, and concurrently securing the extended edge of the sidewall panel, the sidewall panel and the bottom wall with seam 128.

Figure 1C:
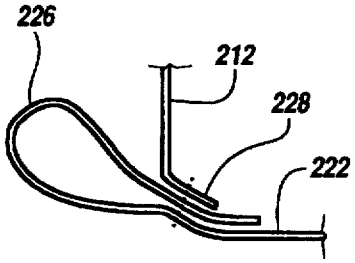
FIG. 1C is an enlarged sectional view illustrating a second alternative embodiment of the lift loop and bottom seam of the bulk bag of FIG. 1.

FIG. 1C discloses a second alternative embodiment of the bottom seam incorporating many important parts which are substantially identical in construction and function to component parts of the lift loop 26 and bottom seam 28 illustrated in FIG. 1A. The bottom wall 222 is secured to the sidewall panel 212 forming lift loop 226 in the same manner as described with reference to FIG. 1A. The bottom lift bulk bag 10 is then turned inside out prior to use or to securing a top wall 16, leaving the seam 228 on the inside of the bulk bag.

Figure 1D:
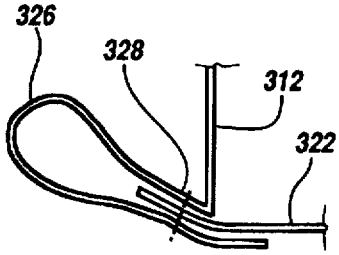
FIG. 1D is an enlarged sectional view illustrating a third alternative embodiment of the lift loop and bottom seam of the bulk bag of FIG. 1.

FIG. 1D discloses a third alternative embodiment of the bottom seam incorporating many important parts which are substantially identical in construction and function to component parts of the lift loop 26 and bottom seam 28 illustrated in FIG. 1A. The sidewall 312 of the bulk bag 10 is extended beyond the bottom wall 322 to form the lift loop 326. The lift loop 326 is formed by folding back a first opposing edge of the sidewall 312 toward the bottom wall 322, positioning an edge portion of the bottom wall 22 between the extended edge of the sidewall panel and the sidewall panel, and concurrently securing the extended edge of the sidewall panel, the bottom wall and the sidewall panel with seam 328.

Figure 1E:
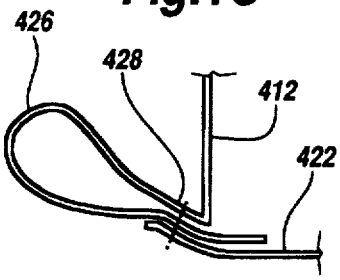
FIG. 1E is an enlarged sectional view illustrating a fourth alternative embodiment of the lift loop and bottom seam of the bulk bag of FIG. 1.

FIG. 1E discloses a fourth alternative embodiment of the bottom seam incorporating many important parts which are substantially identical in construction and function to component parts of the lift loop 26 and bottom seam 28 illustrated in FIG. 1A. The sidewall panel 412 of the bulk bag 10 is extended beyond the bottom wall 422 to form the lift loop 426. The lift loop 426 is formed by folding back a first opposing edge of the sidewall panel 412 toward the bottom wall 422, inserting a first edge between the bottom wall 422 and sidewall panel 412, and concurrently securing the extended first edge of the sidewall, the sidewall and the bottom wall with seam 428.

Figure 1F:
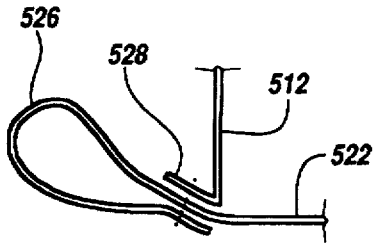
FIG. 1F is an enlarged sectional view illustrating a fifth alternative embodiment of the lift loop and bottom seam of the bulk bag of FIG. 1.

FIG. 1F discloses a fifth alternative embodiment of the bottom seam incorporating many important parts which are substantially identical in construction and function to component parts of the lift loop 26 and bottom seam 28 illustrated in FIG. 1A. The bottom wall 522 of the bulk bag 10 is extended beyond the bottom wall 522 to form the lift loop 526. The lift loop 526 is formed by folding downwardly and back a first opposing edge of the bottom wall 522 toward the bottom wall 522, overlaying the extended edge of the bottom wall over the bottom wall and concurrently securing the extended first edge of the bottom wall, the sidewall and the bottom wall with seam 528.

Figure 1G:
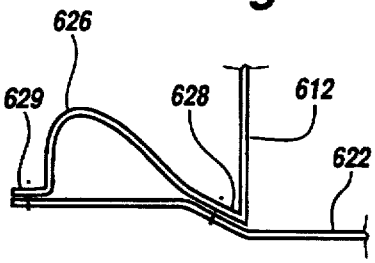
FIG. 1G is an enlarged sectional view illustrating a fifth alternative embodiment of the lift loop and bottom seam of the bulk bag of FIG. 1.

FIG. 1G discloses a sixth alternative embodiment of the bottom lift loop incorporating many important parts which are substantially identical in construction and function to component parts of the lift loop 626 and bottom seam 28 illustrated in FIG. 1A. Both the bottom wall 622 and the sidewall 612 of the bulk bag 10 are extended and secured together in seam 629 to form the lift loop 626. The lift loop 626 is formed by securing the extended edge of the bottom wall 622 to the extended edge of the sidewall 612 at seam 629, and securing the sidewall 612 and the bottom wall 622 at seam 628.

Figure 1H:
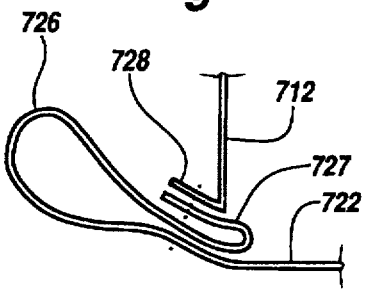
FIG. 1H is an enlarged sectional view illustrating a sixth alternative embodiment of the lift loop and bottom seam of the bulk bag of FIG. 1.

FIG. 1H discloses a seventh alternative embodiment that my be used in conjunction with embodiments 1A to 1G. FIGS. 1H illustrates a pre-sewn hem 727 on the opposing extended edges of the bottom wall 722. A lift loop 726 is formed in a like manner as loop 26 of FIG. 1A. Seam 728 concurrently secures the extended first edge of the bottom wall 722, the sidewall 712 and the bottom wall 722, thereby increasing the material thickness to four layers for added strength at the seam. It being understood that the hem may be placed in either the opposing edges of the bottom wall of the respective adjacent sidewall and that the seam forming the bottom lift loop may be formed by any of the embodiments shown in FIGS. 1A to 1G.

Figure 1I:
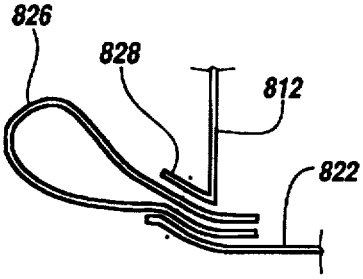
FIG. 1I is an enlarged sectional view illustrating a seventh alternative embodiment of the lift loop and bottom seam of the bulk bag of FIG. 1.

FIG. 1I discloses an eighth alternative embodiment of the bottom lift loop incorporating many important parts which are substantially identical in construction and function to component parts of the lift loop 26 and bottom seam 28 illustrated in FIG. 1A. The lift loop 826 is formed by positioning a fabric loop 826 between the edge of the bottom wall 822 and the sidewall panel 812, and concurrently securing the sidewall panel, the fabric loop 826 and the bottom wall with seam 828.

Figure 2:
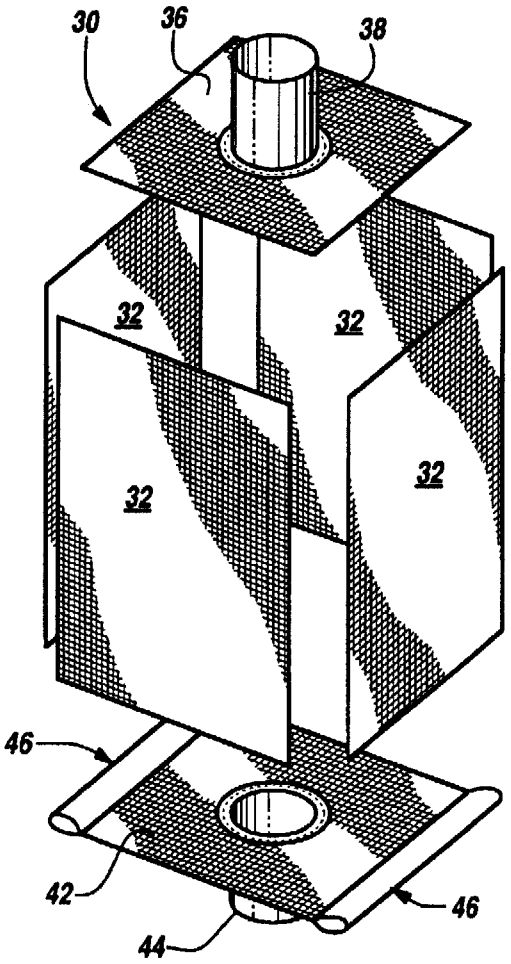
FIG. 2 is an exploded perspective view of a bulk bag comprising a first embodiment of the present invention.

FIG. 2 illustrates a bottom lift bulk bag 30 comprising a first embodiment of the invention. The bulk bag 30 comprises four sidewall panels 32, an optional top wall 36 which may be provided with a fill spout 38 and a bottom wall 42 which may be provided with a discharge spout 44.

The bottom wall 42 of the bulk bag 30 is generally square or rectangular in configuration, and the sidewall panels 32 are joined together along sidewall seams situated at the corners of the bottom wall 42. The sidewall panels may be joined together utilizing conventional sewing or conventional adhesive manufacturing techniques. The material comprising the bottom wall 42 is extended beyond the sidewall panels 32 and is doubled back to define a pair of lift loops 46, each having a length substantially equal to the width of the adjacent sidewall panel 32. The loops 46 are preferably secured in place by seams which also secure the sidewall panels 32 to the bottom wall 42, it being understood that other manufacturing techniques may be utilized in the practice of the invention if desired.

Figure 3:
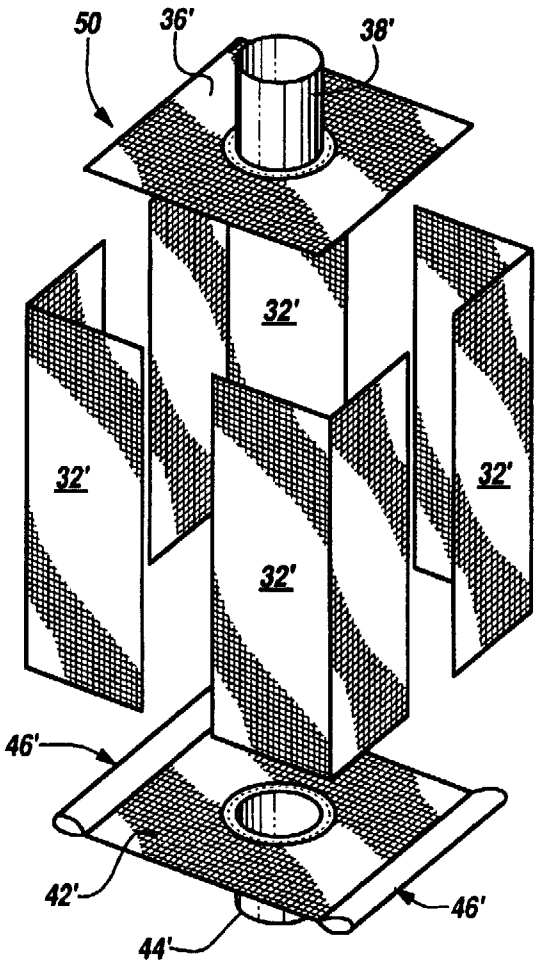
FIG. 3 is an exploded perspective view of a bulk bag comprising a second embodiment of the present invention.

FIG. 3 illustrates a bottom lift bulk bag 50 which incorporates many important parts which are substantially identical in construction and function to component parts of the bottom lift bulk bag 30 illustrated in FIG. 2. Such identical component parts are designated in FIG. 3 with the same reference numerals utilized hereinabove in the description of the bottom lift bulk bag 30, but are differentiated therefrom by means of a prime (') designation.

The bottom lift bulk bag 50 differs from the bottom lift bulk bag 30 primarily in the fact that the sidewall panels 32' are interconnected by means of seams which are not located in alignment with the corners of the bottom panel 42', but instead are situated at the mid points of the four edges defining the bottom wall 42'. Such construction is advantageous when it is desired to utilize baffles in a bulk bag to assist in retaining the square or rectangular cross-sectional configuration of the bulk bag after the bag is filled. Such baffle construction techniques are illustrated and described in U.S. Pat. Nos. 5,165,802 and 5,203,633, the disclosures of which are incorporated herein by reference.

Figure 4:
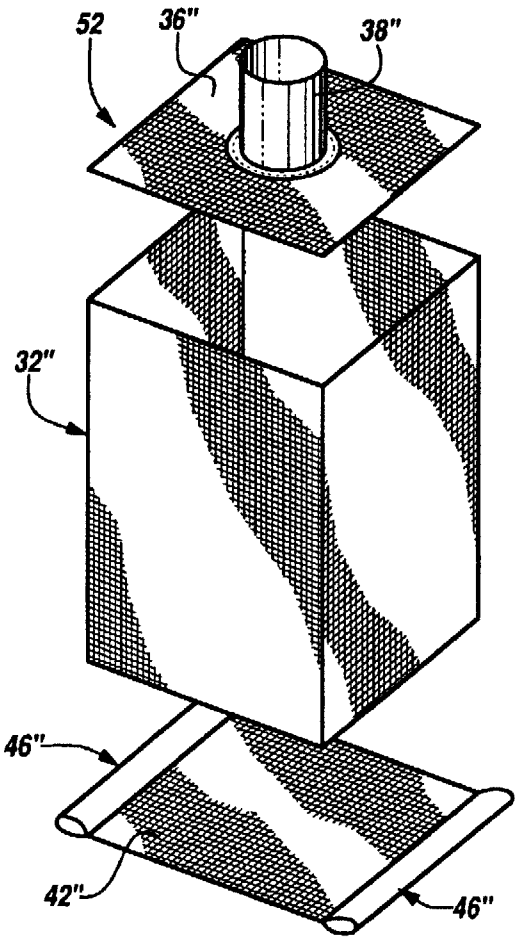
FIG. 4 is an exploded perspective view of a bulk bag comprising a third embodiment of the present invention.

FIG. 4 illustrates a bottom lift bulk bag 52 which incorporates many component parts which are substantially identical in construction and function to component parts of the bottom lift bulk bag 30 illustrated in FIG. 2. Such identical component parts are designated in FIG. 4 with the same reference numerals utilized hereinabove in the description of the bottom lift bulk bag 30 of FIG. 2, but are differentiated therefrom by means of a double prime (") designation.

The bottom lift bulk bag 52 differs from the bottom lift bulk bag 30 primarily in the fact that it incorporates a single sidewall panel 32", which is preferably constructed by means of circular weaving techniques. Although the single sidewall 32" of the bottom lift bulk bag 52 initially has a tubular configuration, it assumes a rectangular configuration as shown in FIG. 4 when it is interconnected with the top wall 36" and the bottom wall 42" to construct the bulk bag 52. The bottom wall 42" is shown with no discharge spout. As previously discussed herein, a bag with no discharge spout is referred to as a plain bottom or solid bottom bag. It is readily known in the art of bulk bag manufacture that any of the bulk bags illustrated by FIGS. 1–4 may be made with or without a discharge spout.

Figures 5, 8, 9:
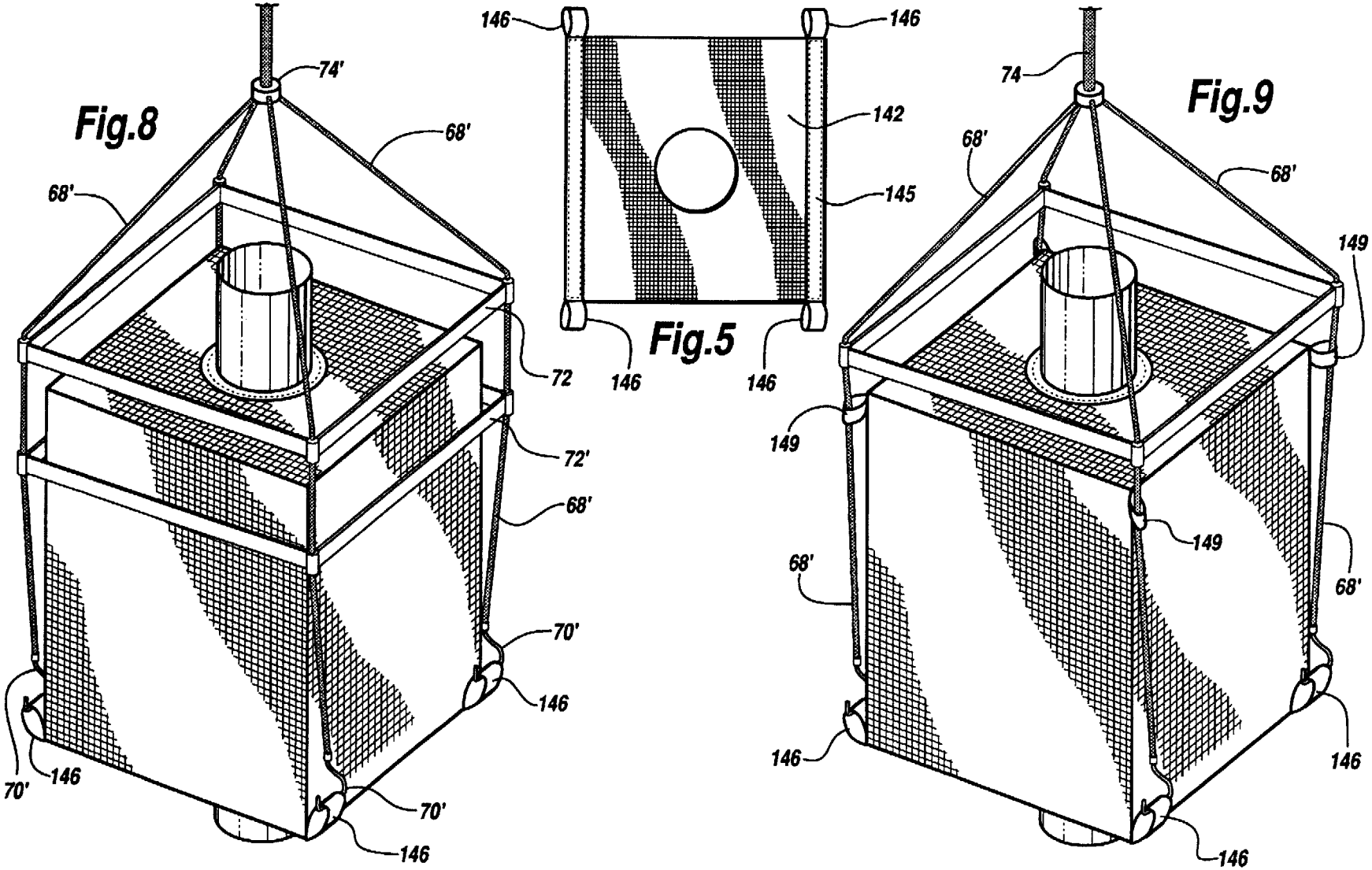
FIG. 5 is a bottom view of an alternative bottom of the the bulk bag constructed in accordance with the present invention.
FIG. 8 is a perspective view illustrating the lifting of a bulk bag constructed in accordance with an alternative embodiment of the present invention.
FIG. 9 is a perspective view illustrating the use of spacer loops for lifting the bulk bag constructed in accordance with an alternative embodiment of the present invention.

FIG. 5 illustrates a bottom view of an alternative bottom 142 of the bags of FIGS. 2, 3, and 4. Bottom 142 may include discharge spout 144. Bottom 142 differs from the other embodiments in the manner of forming lift loops 146. Lift loops 146 are formed from a strap of conventional webbing 145 secured to the bottom 142. The strap of webbing 145 is extended beyond the edges of the bottom wall and then opposing ends of the webbing are folded back and secured to the webbing itself or alternatively secured to the bottom wall.

Figures 6, 7, 10:
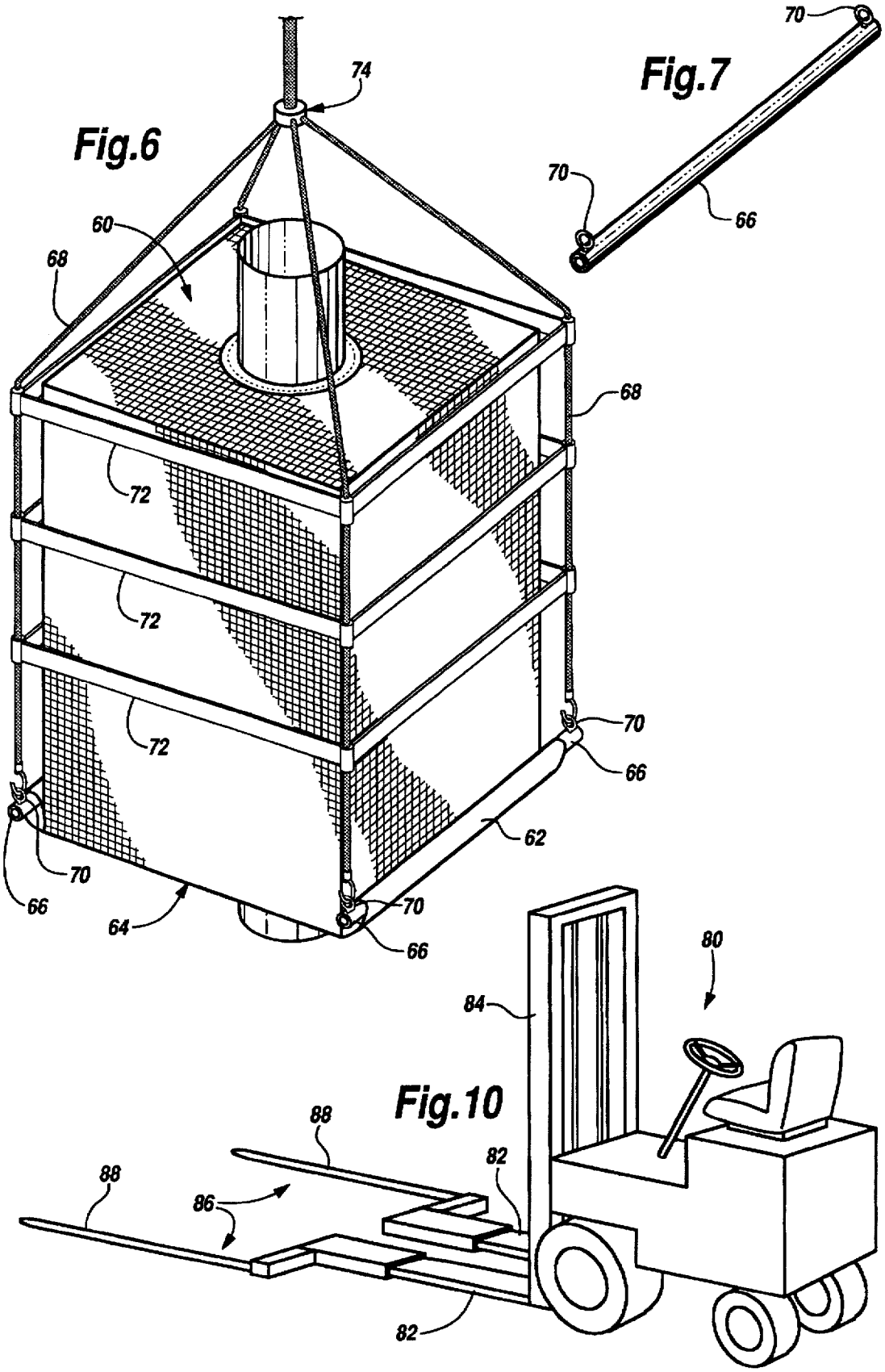
FIG. 6 is a perspective view illustrating the lifting of a bulk bag constructed in accordance with the invention.
FIG. 7 is an illustration of a lifting member useful in the practice of the invention as illustrated in FIG. 5.
FIG. 10 is an illustration of a forklift adapter useful in the practice of the invention.

A first method of use for the bottom lift bulk bag constructed in accordance with the present invention is illustrated in FIG. 6. A bottom lift bulk bag 60 constructed as illustrated in FIGS. 2–4 hereof and described hereinabove in conjunction therewith is lifted by means of lift loops 62 situated at the bottom of the bottom lift bulk bag 60 and comprising extensions of the bottom wall 64 thereof. Rigid lifting members 66 are extended through the lift loops 62. Flexible lift members 68 are secured to the rigid lift members 62 by means of connectors 70. The flexible lift members 68 may comprise chains or wire ropes, and the connector 70 may comprise conventional hook and eye devices or other well-known apparatuses of the type typically utilized to interconnect flexible and rigid lifting members.

One or more spacers 72 may be provided at spaced-apart points on the flexible lifting member 68. The spacers 72 may be either rigid or flexible in construction, as desired. The purpose of the spacers 72 is to prevent the bulk bag 60 and the contents thereof from tipping during the lifting operation. The flexible lifting members 68 are joined together at their respective upper ends by a collar or other joining member 74 and are in turn subjected to an upward lifting force by a crane or other lifting mechanism. The lifting force applied to the flexible lifting member 68 is in turn applied to the rigid lifting member 66 by means of the fasteners 70. The rigid lifting members 66 transfer the lifting force to the bulk bag 60 by means of the lift loops 62 thereof. By this means, the bottom lift bulk bag 60 and the contents thereof are lifted from the bottom.

FIG. 7 illustrates one of the rigid lifting members 66 as illustrated in FIG. 6. The rigid lifting members 66 may comprise either hollow or rigid shafting dimensioned for receipt within the lift loops 62 and characterized by adequate strength to support the bottom lift bulk bag 60 and the contents thereof. The rigid lifting member 66 may have portions of the connectors 70 rigidly secured thereto, if desired.

FIG. 8 discloses a first alternative method of use for the bottom lift bulk bag constructed in accordance with the embodiment of the present invention disclosed in FIG. 5. The bottom lift bulk bag is lifted by means of lift loops 146 situated at the bottom of the bottom lift bulk bag. Flexible lift members 68' are secured to the lift loops 146 by means of connectors 70' The flexible lift members 68' may comprise chains or wire ropes, and the connector 70' may comprise conventional hook and eye devices or other well-known apparatuses of the type typically utilized to interconnect flexible and rigid lifting members.

One or more spacers 72' may be provided at spaced-apart points on the flexible lifting member 68'. The spacers 72' may be either rigid or flexible in construction, as desired. The purpose of the spacers 72' is to prevent the bulk bag and the contents thereof from tipping during the lifting operation. The flexible lifting members 68' are joined together at their respective upper ends by a collar or other joining member 74 and are in turn subjected to an upward lifting force by a crane or other lifting mechanism. The lifting force applied to the flexible lifting member 68' is in turn applied to the lift loops 142 by means of the fasteners 70' By this means, the bottom lift bulk bag and the contents thereof are lifted from the bottom.

FIG. 9 illustrates the use of a fabric spacer loop attached to the sidewall seams of the bag. The other elements operate as described with regard to FIG. 8. The purpose of the spacer loops 149 is to prevent the bulk bag and the contents thereof from tipping during the lifting operation.

FIG. 10 illustrates a forklift truck 80 which is conventional in construction and operation. The forklift truck 80 has conventional forklift tines 82 which are adapted to be raised and lowered by means of a mast 84 comprising part of the forklift truck 80. Adapters 86 are provided at the distal ends of the tines 82 and comprise spaced apart lifting tines 88 which are adapted to be received in the lift loops 62 of the bottom lift bulk bag 60. By this means, the forklift truck may be used to lift the bottom lift bulk bag 60 from the bottom thereof in a manner similar to the lifting technique illustrated in FIG. 6 and described hereinabove in conjunction therewith.

In the practice of the invention, it has been found that the use of the present invention results in a bulk bag construction which is considerably less expensive to manufacture than is the case when top lift construction techniques are employed.

Although preferred embodiments of the present invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A bottom lift bulk bag comprising:

a sidewall;

a bottom wall; and a pair of opposed bottom lift loops adapted to receive lifting members for lifting said bag and the contents thereof, said lift loops having:

two extended opposing edges of the bottom wall folded upwardly and back toward each respective adjacent sidewall, said extended edges being inserted between the bottom wall and the respective adjacent sidewall, said extended edges being secured concurrently with the respective adjacent sidewall to the bottom wall.

2. A method of manufacturing a bottom lift bulk bag comprising:

providing a sidewall;

providing a bottom wall; and forming a pair of opposed bottom lift loops adapted to receive lifting members for lifting said bag and the contents thereof, including the steps of:

folding upwardly and back two extended opposing edges of the bottom wall toward each respective adjacent sidewall, inserting said extended edges of the bottom wall between the bottom wall and the respective adjacent sidewall, and concurrently securing said extended edges of the bottom wall, the respective adjacent sidewall and the bottom wall.

3. A bottom lift bulk bag comprising:

a sidewall;

a bottom wall; and a pair of opposed bottom lift loops adapted to receive lifting members for lifting said bag and the contents thereof, said lift loops having:

two extended opposing edges of the bottom wall folded upwardly and back toward each respective adjacent sidewall, a lower portion of the respective adjacent sidewall being inserted between the extended edge of the bottom wall and respective adjacent sidewall, said extended edges of the bottom wall being secured concurrently with the respective adjacent sidewall to the bottom wall.

4. A bottom lift bulk bag comprising:

a sidewall;

a bottom wall; and a pair of opposed bottom lift loops adapted to receive lifting members for lifting said bag and the contents thereof, said lift loops having:

two extended opposing edges of the bottom wall folded downward and back toward each respective adjacent sidewall, said extended edges of the bottom wall being overlaid over the adjacent bottom wall, said extended edges of the bottom wall being secured concurrently with the respective adjacent sidewall to the bottom wall.

5. A method of manufacturing a bottom lift bulk bag comprising:

providing a sidewall;

providing a bottom wall; and forming a pair of opposed bottom lift loops adapted to receive lifting members for lifting said bag and the contents thereof, including the steps of:

folding back and downwardly two extended opposing edges of the bottom wall toward the bottom wall, overlaying said extending edges of the bottom wall over the adjacent bottom wall, and concurrently securing said extended edges of the bottom wall, the respective adjacent sidewall and the bottom wall.

6. A bottom lift bulk bag comprising:

a sidewall;

a bottom wall; and a pair of opposed bottom lift loops adapted to receive lifting members for lifting said bag and the contents thereof, said lift loops having:

two extended opposing edges of the bottom wall, said edges pre-hemmed by folding over and securing a portion of the bottom wall to itself, said extended edges of the bottom wall including the hem being folded upwardly and back toward each respective adjacent sidewall, said extended edges and hem being inserted between the bottom wall and the respective adjacent sidewall, said extended edges and hem being secured concurrently with the respective adjacent sidewall to the bottom wall.

7. A method of manufacturing a bottom lift bulk bag comprising:

providing a sidewall;

providing a bottom wall with a pre-hemmed edge; and forming a pair of opposed bottom lift loops adapted to receive lifting members for lifting said bag and the contents thereof, including the steps of:

folding upwardly and back two extended opposing edges of the bottom wall including the hem toward each respective adjacent sidewall, inserting said extended edges of the bottom wall including the hem between the bottom wall and the respective adjacent sidewall, and concurrently securing said extended edges of the bottom wall and hem, the respective adjacent sidewall and the bottom wall.

* * * * *

UNITED STATES PATENT AND TRADEMARK OFFICE

CERTIFICATE OF CORRECTION

PATENT NO. : 5,695,286

DATED : December 9, 1997

INVENTOR(S) : Robert R. Williamson et al

It is certified that error appears in the above-indentified patent and that said Letters Patent is hereby corrected as shown below:

Prior to BACKGROUND OF INVENTION, Column 1

Insert --TECHNICAL FIELD

This invention relates generally to flexible intermediate bulk containers, also known as bulk bags, and more particularly to bulk bags adapted for bottom lifting.--

Column 5, Line 6

Replace: "22"

With: --322--

Signed and Sealed this

Twenty-fourth Day of February, 1998

*Attest:*

Bruce Lehman

BRUCE LEHMAN

*Attesting Officer*

*Commissioner of Patents and Trademarks*